US005180076A

United States Patent [19]

Hundt

[11] Patent Number: 5,180,076

[45] Date of Patent: Jan. 19, 1993

[54] WASTE CONTAINER

[75] Inventor: Gary Hundt, Lincoln, Nebr.

[73] Assignee: Progressive Technologies, Inc., Smyrna, Ga.

[21] Appl. No.: 663,246

[22] Filed: Mar. 1, 1991

[51] Int. Cl.[5] ..... B65D 4/04

[52] U.S. Cl. ..... 220/420; 220/288; 220/659; 220/627

[58] Field of Search ..... 220/659, 446, 420, 627, 220/288

[56] References Cited

U.S. PATENT DOCUMENTS

| | | | |
|---|---|---|---|
| 3,529,743 | 9/1970 | Ehrbar et al. | 220/659 |
| 3,861,021 | 1/1975 | Yamamoto | 220/420 |
| 3,915,330 | 10/1975 | Hammes et al. | 220/659 |
| 3,933,296 | 1/1976 | Ruskin et al. | 229/7.5 |
| 4,005,799 | 2/1977 | Mannaerts | 220/288 |
| 4,014,452 | 3/1977 | Galer | 220/659 |
| 4,109,820 | 8/1978 | Stifano | 220/288 |
| 4,489,852 | 12/1984 | Logan et al. | 220/627 |
| 4,703,853 | 11/1987 | Byrns | 220/420 |
| 4,708,258 | 11/1987 | Shaw et al. | 220/288 |
| 4,709,833 | 12/1987 | Granberg et al. . | |
| 4,711,365 | 12/1987 | Fomby | 220/288 |

*Primary Examiner*—Joseph Man-Fu Moy
*Attorney, Agent, or Firm*—Zarley, McKee, Thomte, Voorhees & Sease

[57] ABSTRACT

A waste container includes a generally cylindrical double-wall drum having separate spaced-apart inner and outer sidewalls and separate spaced-apart inner and outer bottom walls. The inner and outer sidewalls are continuously connected along their upper ends and the inner and outer bottom walls are connected at a plurality of spaced-apart locations. A double-wall lid is provided to seal the container. A neck portion is formed at the upper end of the drum and includes a series of buttress threads on the interior face thereof adapted to engage buttress threads on the lid. A vertically-oriented annular trough is formed below and inwardly of the threads in the neck portion and is adapted to engage an annular toe depending from the lid. An upwardly projecting annular lid is formed immediately adjacent to and inwardly of the annular trough in the drum portion, so as to form an annular S-shaped surface with the annular trough. A cooperating upwardly depressed annular trough in the lid forms an S-shaped surface adapted to engage the S-shaped surface in the drum to form a tight fluid seal.

9 Claims, 5 Drawing Sheets

WASTE CONTAINER

TECHNICAL FIELD

The present invention relates generally to salvage drums and waste containers, and more particularly to containers designed specifically for containing toxic materials.

BACKGROUND OF THE INVENTION

Salvage drums adapted to contain standard industrial chemical drums, commonly known as overpack containers, are known in the art. The standard industrial chemical drums may be utilized in a wide variety of instances for various waste handling tasks, such as medical waste, paint and coatings, bulk food production, EPA cleanup sites, waste incineration sites, etc.

At present, steel containers are widely utilized by the majority of entities having need for such waste containers. Plastic overpacks have only a very small percentage of the existing market, probably due to the reputation of poor closure sealing characteristics. However, subsequent types of plastic containers have met or exceeded steel in their ability to seal, and industry is fast beginning to embrace plastic as a superior alternative to steel for waste containers, rather as mere overpacks.

One of the main problems with steel containers is in the potential for explosions and fires. When placed under pressure, steel containers will explode and will produce a heavy metal residue which cannot be eliminated. Steel is also difficult to handle due to its heavier weight, thereby increasing the possibility of lift related injuries.

Other problems associated with steel containers is in the fact that seams or joints must be utilized—which are a common subject for failure when placed under stress. Thus, the only major advantage to steel containers over prior art plastic containers was in their ability for effective sealing.

It can therefore be seen that plastic containers hold many advantages over steel. They are lighter weight, nestable, easier to handle, non-corrosive and non-conductive so as to reduce spark potential, do not leave heavy metal residue if incinerated, have no seams or joints, and are washable and reusable. The main disadvantage of prior art plastic containers was in their inability to effectively seal against certain impact conditions. In addition, the prior art plastic containers were unable to prevent ruptures through sidewalls during impact conditions which steel containers could withstand.

It is therefore a general object that the present invention to provide an improved plastic waste container which can be securely sealed to withstand severe impacts without leaking.

Another object of the present invention is to provide a plastic waste container which prevents many wall ruptures under severe impact conditions.

A further object is to provide a waste container having a configuration which can be nested to reduce transportation and storage volumes.

Yet another object of the present invention is to provide a waste container which is stackable and interlocking for safe storage and transport.

Still another object is to provide a waste container which is light weight, economic to manufacture and refined in appearance.

These and other objects will be apparent to those skilled in the art.

SUMMARY OF THE INVENTION

The waste container of the present invention includes a generally cylindrical double-wall drum having separate spaced-apart inner and outer sidewalls and separate spaced-apart inner and outer bottom walls. The inner and outer sidewalls are continuously connected along their upper ends and the inner and outer bottom walls are connected at a plurality of spaced-apart locations. A double-wall lid is provided to seal the container. A neck portion is formed at the upper end of the drum and includes a series of buttress threads on the interior face thereof adapted to engage buttress threads on the lid. A vertically-oriented annular trough is formed below and inwardly of the threads in the neck portion and is adapted to engage an annular toe depending from the lid. An upwardly projecting annular lid is formed immediately adjacent to and inwardly of the annular trough in the drum portion, so as to form an annular S-shaped surface with the annular trough. A cooperating upwardly depressed annular trough in the lid forms an S-shaped surface adapted to engage the S-shaped surface in the drum to form a tight fluid seal.

DESCRIPTION OF THE PREFERRED EMBODIMENT

Figure 1:
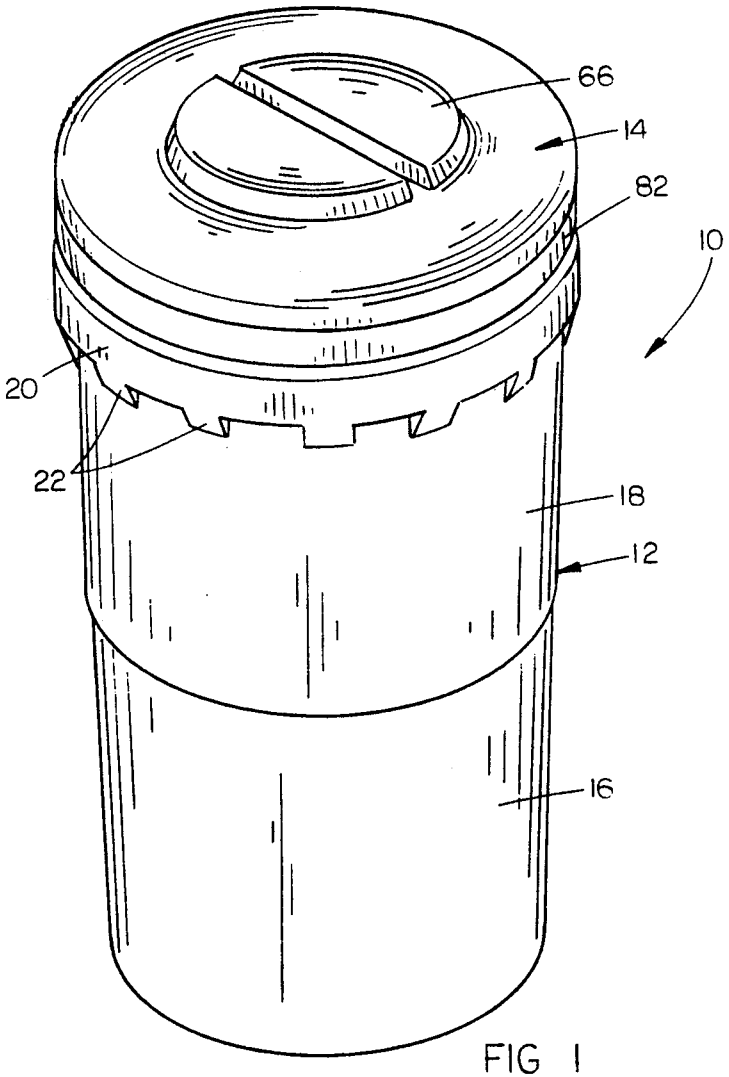
FIG. 1 is a perspective view of the present invention.

Referring now to the drawings, in which similar or corresponding parts are identified with the same reference numeral, and more particularly to FIG. 1, the waste container of the present invention is designated generally at 10 and includes a drum 12 and a lid 14 selectively sealed to the drum 12.

Figure 2:
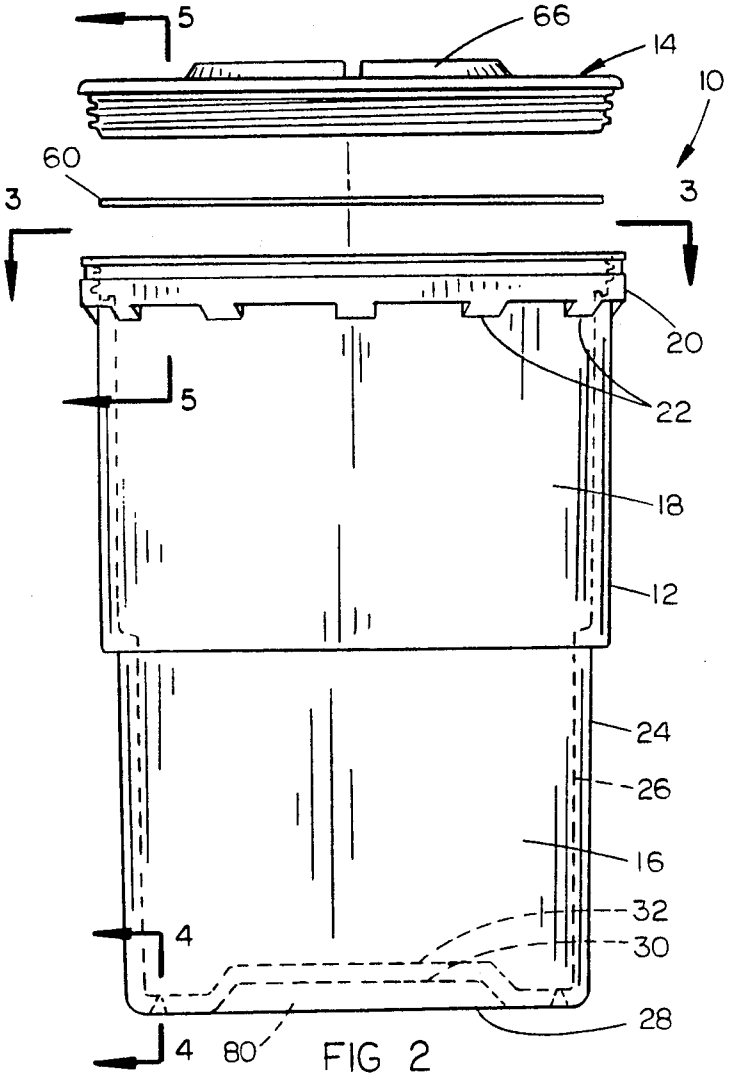
FIG. 2 is a side elevational view of the present invention.

As shown in FIGS. 1 and 2, barrel portion 12 has a lower cylindrical portion 16 and an upper cylindrical portion 18, the upper cylindrical portion 18 having a slightly greater diameter than lower cylindrical portion 16, such that a series of containers 10 may be nested one within the other. A neck 20 is formed at the upper end of upper cylindrical portion 18 and has a greater diameter than upper cylindrical portion 18 for the formation of internal threads, as described hereinbelow. Neck portion 20 includes a series of buttresses 22 spaced apart around circumference of neck 20 to further strengthen the neck 20.

Drum 12 is formed with a double wall construction, including an outer wall 24 and an inner wall 26 (shown in hidden lines in FIG. 2). Similarly, the drum bottom 28 is formed of double wall construction including an outer bottom wall 30 and an inner bottom wall 32. Preferably, outer walls 24 and 30 are approximately one and one-half times thicker than inner walls 26 and 32. The thicker outer wall provides a greater vertical column strength, increases stacking capability, and provides a more durable outer shell for external impacts. A thinner inner wall provides for shock and stress absorption since the thinner wall is more flexible and will move within drum 12. The thinner inner wall also allows for expansion and contraction of the contents of drum 12 due to atmospheric pressure or temperature changes.

Figure 4:
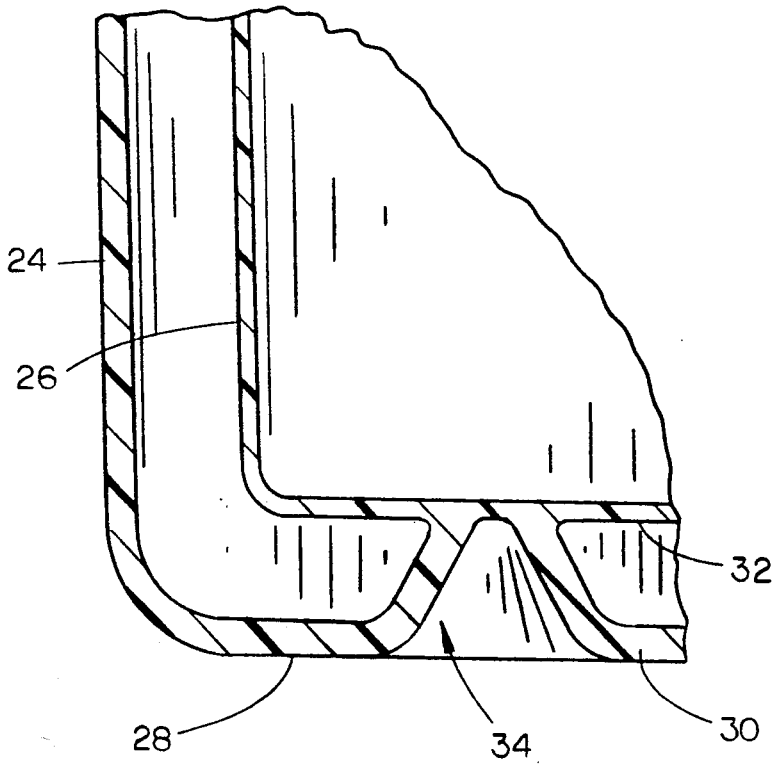
FIG. 4 is a partial sectional view taken at lines 4—4 in FIG. 2.

As shown in FIG. 4, inner walls 26 and 32 are spaced apart from outer walls 24 and 30. In the preferred embodiment, container 10 is an approximately 85 gallon container, and the space between inner and outer walls is between ¾ of an inch and 1½ inches. This twin wall construction provides additional protection from leakage in that external damage to the outer wall does not affect the inner wall's integrity. Similarly, if the inner wall fails, the outer wall will contain the contents of the drum.

Figure 3:
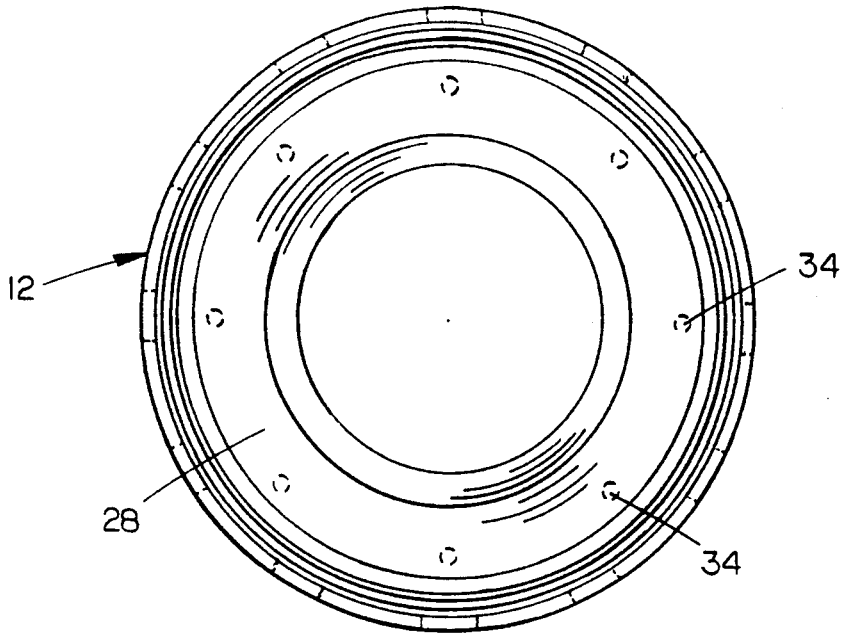
FIG. 3 is a top view of the invention taken at lines 3—3 in FIG. 2.

FIG. 3 shows a plurality of uniformly spaced "kiss-offs" 34 in hidden lines, around the circumference of the bottom 28 of drum 12. Each kiss-off 34 is a point wherein the outer and inner walls 30 and 32 are fused together, as shown in FIG. 4. The kiss-offs 34 in the bottom 28 of drum 12 secure the inner and outer walls for drop strength and stress control. They also serve to uniformly transfer the load from inner bottom wall 32 to outer bottom wall 30.

Figure 5:
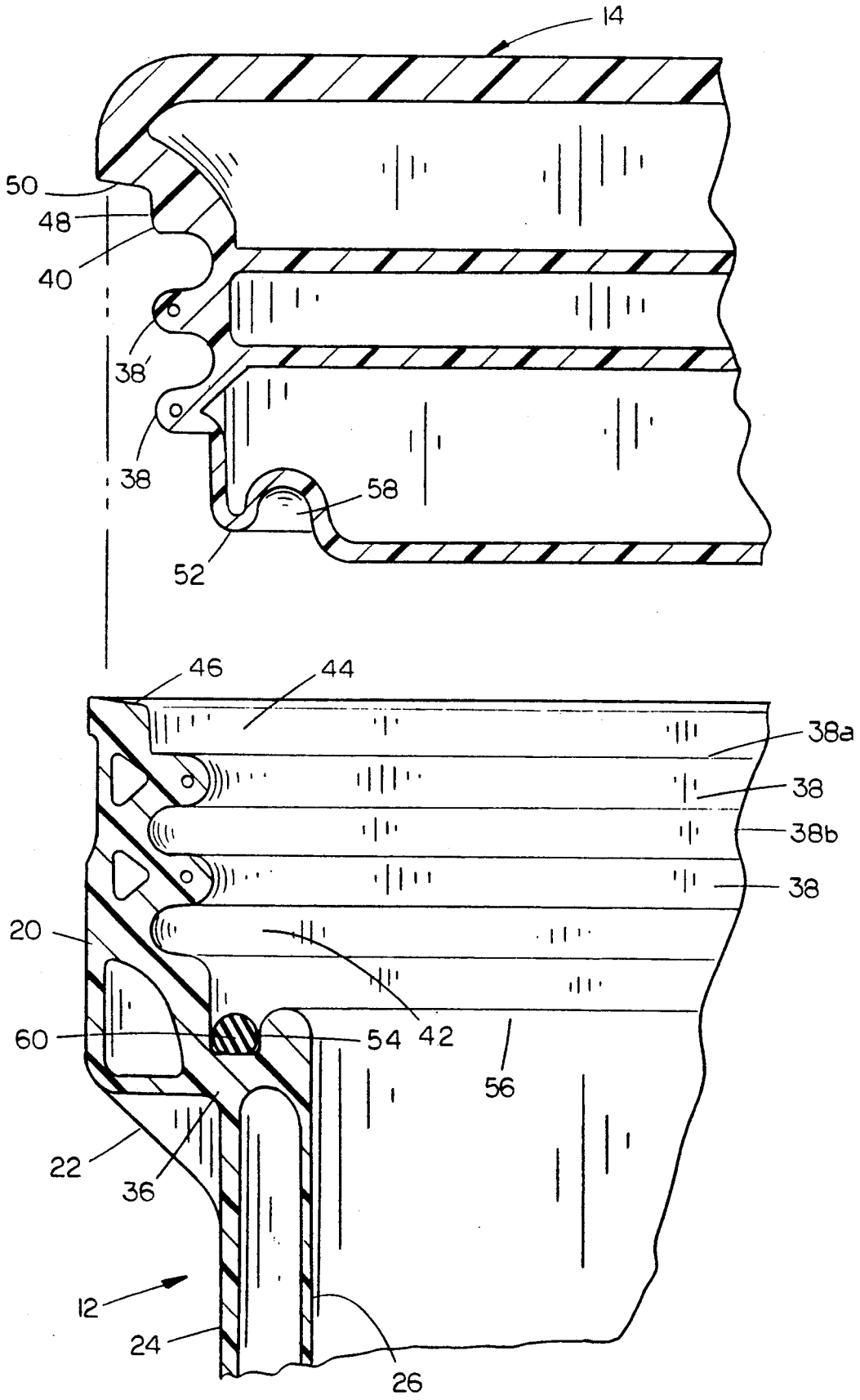
FIG. 5 is a partial sectional view taken at lines 5—5 in FIG. 2.
Figure 6:
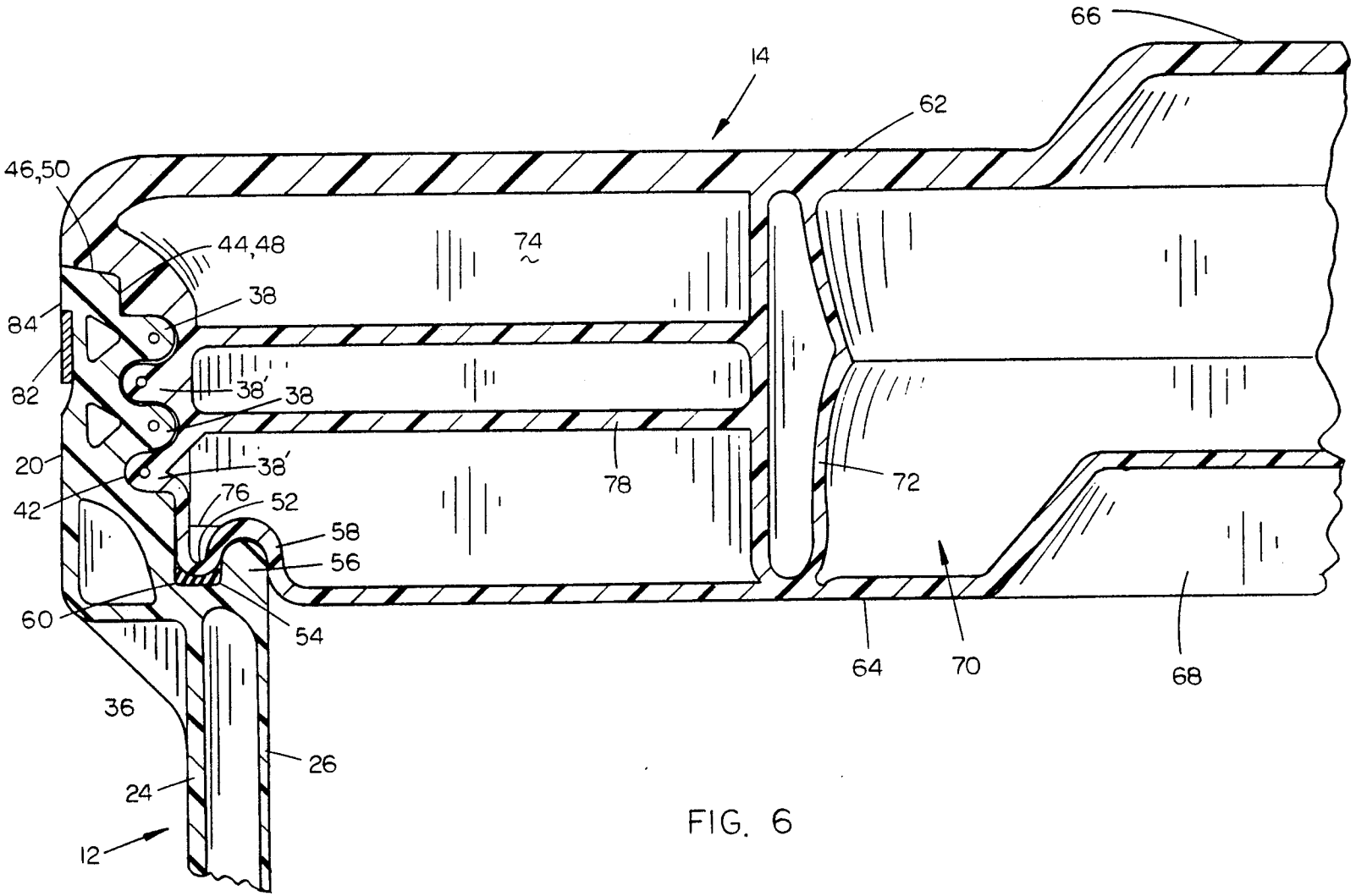
FIG. 6 is a vertical sectional view through a portion of the lid and sidewall with the lid locked in place on the container.

Referring now to FIGS. 5 and 6, neck 20 is fused to the upper end of outer wall 24 to form a continuous fused joint 36. In addition, the upper ends of outer and inner walls 24 and 26 are designed to fuse together so as to increase the strength of neck 20. As noted above, uniformly spaced buttresses 22 extend around the circumference of drum 12 and will strengthen the connection of neck 20 to the upper end of outer and inner walls 24 and 26.

Neck portion 20 is interiorly threaded utilizing a buttress thread 38. Buttress thread 38 is a projecting helical rib formed on the inner surface of neck 20 with flat and generally parallel sidewalls 38*a* and 38*b*. A similar and corresponding buttress thread 38 prime is formed on the circumferential vertical wall 40 of lid 14. In this fashion, the flat sidewalls of thread 38 will contact the flat sidewalls of threads 38 prime on the lid so that there is direct loading on generally horizontal flat walls, so as to prevent slippage and reduce the risk of leaks between the threads of the lid and drum.

There is a dimensional reduction in the trough 42 in neck 20 formed to receive the lower most thread 38' of lid 14, such that the rotation of lid 14 onto drum 12 will cause a "wedging action" which will lock the threads by friction. Since buttress threads 38 and 38' utilize flat sidewalls, it can be seen that load stresses are spread over large surface areas and at right angles to the threads. In this fashion, dropping the container would not cause the threads to slip or leak.

In order to seal the threads from possible hydraulic pressure, a vertical wall 44 projects upwardly from the upper most thread 38 on neck 20 forming a generally horizontal rim surface 46. A corresponding vertical wall 48 and generally horizontal cap surface 50 extending circumferentially around lid 14. As shown in FIG. 6, walls 44 and 48 and rim and cap surfaces 46 and 50 will abut to form a seal preventing the entrance of fluid under hydraulic pressure from the exterior of waste container 10 to threads 38.

An annular depending rib or toe 52 depends from lid 14 below the lowermost thread 38'. Toe 52 is designed to engage an annular trough 54 formed in neck 20 above the fused connection of outer and inner walls 24 and 26. An upwardly projecting annular rib 56 directly above inner wall 26 serves to form trough 54 and will be received within a corresponding trough 58 in lid 14. In this fashion, the toe and trough 52 and 58 of lid 14 will engage the trough and rib 54 and 56 of drum 12 when lid 14 is threaded onto neck 20. This locking toe 52 prevents stress buildup on threads 38 in the event that the waste container 10 is dropped, or other generally vertical impact force is applied to the container.

Preferably, a bead of silicone 60 is applied within trough 54 prior to attachment of lid 14 on drum 12, as shown in FIG. 5. When the lid 14 is installed, toe 52 will compress the silicone bead 60 to form a gasket or seal to prevent the escape of material from the interior of container 10. Other types of gasket material may be utilized in place of silicone, depending upon the characteristics of the material placed in the container.

Figure 7:
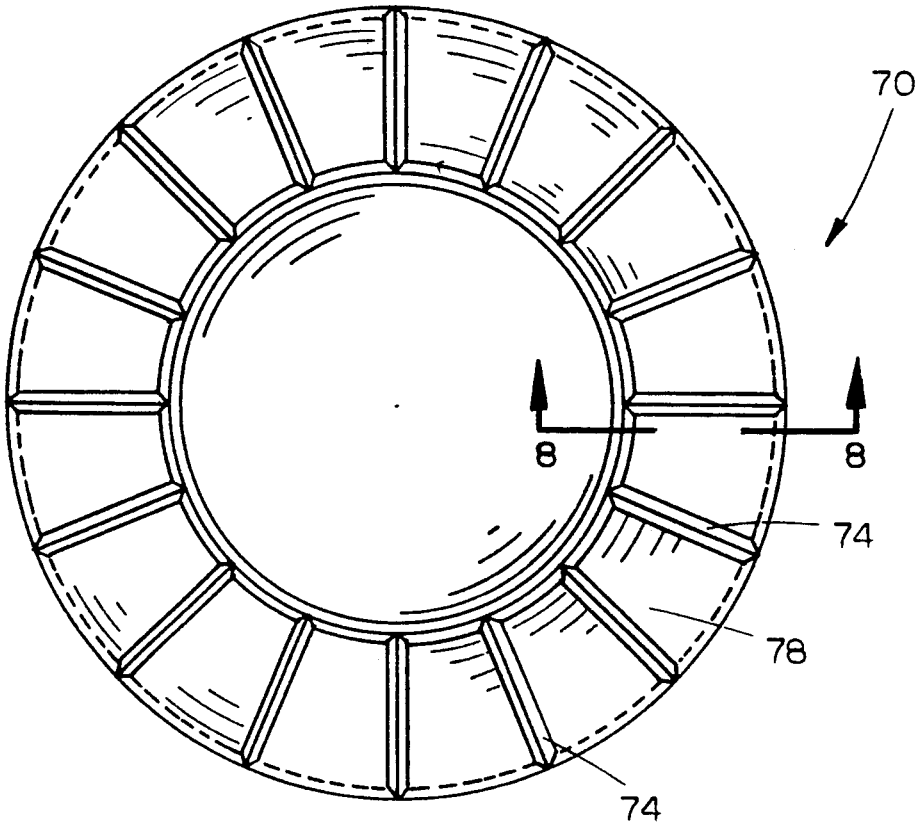
FIG. 7 is a view of an insert formed within the lid of the container.
Figure 8:
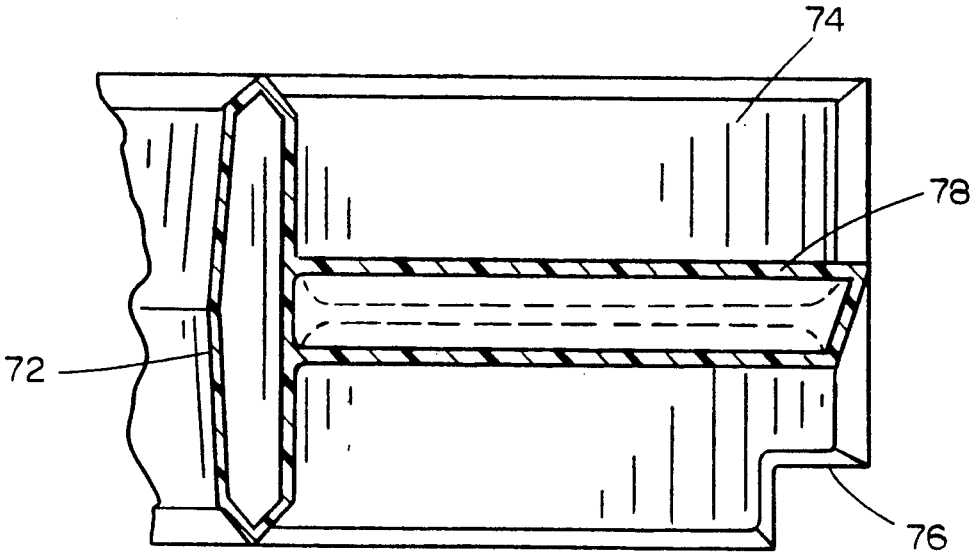
FIG. 8 is a sectional view taken at lines 8—8 in FIG. 7.

Referring now to FIGS. 6–8, lid 14 is also formed of a twin wall construction, so as to have an upper wall 62 and lower wall 64, the upper wall being thicker than lower wall 64. As discussed above, the circumferential vertical sidewall 40, connecting upper and lower walls 62 and 64 has a thread 38' formed therein for connection to the thread 38 on drum 12. A generally disk shaped projection 66 in upper wall 62 corresponds with a generally disk shaped depression 68 in lower wall 64, such that a plurality of lids 14 may be stacked one atop the other with the projections and depressions 66 and 68 nesting the lids together.

FIGS. 7 and 8 show views of a plastic insert which is fused to upper and lower walls 62 and 64 and vertical sidewall 40 within lid 14. Insert 70 is generally wheel shaped with a cylindrical hub 72 formed by a hollow vertical wall, and a plurality of radially projecting and uniformly spaced apart spokes 74 formed by vertical walls. A notch 76 is formed in the lower free edge of spokes 74 to receive the trough 58 in lower wall 64 of lid 14, as shown in FIG. 6. An annular hollow ring 78 forms bridging between spokes 74 and extends from hub 72 to a radius equal to the extent of spokes 74. The upper and lower edges of hub 72 and spokes 74, as well as the vertical edges of spokes 74, are beveled so as to enhance fusion when formed within lid 14. FIG. 6 shows lid 14 with insert 70 fused therein.

The insert 70 fused within lid 14 strengthens the threads on vertical sidewall 40 as well as strengthening the entire lid 14. The twin walls of the lid provide additional protection from spillage, since a rupture to one of the walls will not effect the integrity of the other.

To aid in the transport of stacked drums, a disk shaped depression 80 is formed in the bottom of drums 12, as shown in FIG. 2. Depression 80 is formed to receive the disk shaped projection 66 of lid 14, to interlock stacked drums.

While unnecessary for effective use of waste container 10, a metal band 82 (shown in FIGS. 1 and 6) may be strapped around neck 20 of drum 12 within an annular depression 84 formed in the exterior of neck 20. Band 82 will assist in holding the threads 38 engaged with threads 38 prime on lid 14, and to keep neck 20 from spreading when placed under high pressure. The band is not necessary to keep the lid on and could be removed prior to incineration of the waste container 10.

In order to provide a lightweight container, the container and lid are preferably formed of a plastic material such as: polyethylene, polypropylene, nylon or teflon. In the preferred embodiment the container, including lid and lid insert, is formed of linear-low medium density polyethylene (LLDPE), with an ultraviolet inhibitor and an antioxidant agent.

Whereas the invention has been shown and described in connection with the preferred embodiment thereof, it will be understood that many modifications, substitutions and additions may be made which are within the intended broad scope of the appended claims. There has therefore been shown and described an improved waste container which accomplishes at least all of the above-stated objects.

I claim:

1. A waster container, comprising:

a generally cylindrical double-wall drum having separate spaced apart inner and outer sidewalls and separate spaced apart inner and outer bottom walls;

said inner and outer sidewalls being continously connected at an upper end thereof;

said inner and outer bottom walls being connected in a plurality of spaced apart locations;

a lid removably connected to the upper end of said drum to seal the container;

a neck portion formed at the upper end of said drum, having a greater diameter than the outer sidewall and having inner and outer faces;

the inner face of said neck portion having threads formed therein;

said lid having upper and lower horizontal walls and a generally cylindrical vertical sidewall connecting the upper and lower walls;

said lid having an exterior thread formed in a portion of said sidewall adapted to engage the neck portion thread to connect the lid to the drum;

a vertically-oriented annular trough formed in the connection of said outer and inner sidewalls to said neck portion, and inwardly of said threads on the neck portion;

an annular toe depending from the lower wall of said lid adapted for engagement with said annual trough;

an upwardly projecting annular rib formed immediately adjacent to and inwardly of said annular trough in said drum portion;

an upwardly depressed annular trough formed immediately adjacent and inwardly of said annular toe in said lid, adapted to receive the projecting rib of said drum; and said annular trough and adjacent rib on said drum forming a generally S-shaped annular surface adapted to engage the generally S-shaped annular surface formed by said toe and trough in said lid.

2. The waste container of claim 1 further comprising a plurality of spaced-apart buttresses extending between said outer sidewall and said neck portion.

3. The waste container of claim 1, wherein said threads are buttress threads.

4. The waste container of claim 1, further comprising a resilient compressable gasket interposed in said trough in said neck portion, engaged and compressed by said toe on said lid to form a fluid seal when the lid is connected to the drum.

5. The waste container of claim 1, wherein said neck portion has a flat, generally horizontal rim formed on its upper end, with a generally vertical inner wall adjacent thereto, to form a shoulder at the upper end of the threaded portion of said neck portion, said lid having a flat, generally horizontal cap surface with a depending generally vertical wall portion adjacent thereto adapted to receive said shoulder portion to form an abutting seal upwardly of said threaded portions of the drum and lid.

6. The waste container of claim 1, wherein said neck portion has a flat, generally horizontal rim formed on its upper end, with a generally vertical inner wall adjacent thereto, to form a shoulder at the upper end of the threaded portion of said neck portion, said lid having a flat, generally horizontal cap surface with a depending generally vertical wall portion adjacent thereto, adapted to receive said shoulder portion to form an abutting seal upwardly of said threaded portions of the drum and lid.

7. The waste container of claim 1, wherein the said drum and lid are molded from plastic.

8. A waster container, comprising:

a generally cylindrical double-wall drum having separate spaced apart inner and outer sidewalls and separate spaced apart inner and outer bottom walls;

said inner and outer sidewalls being continously connected at an upper end thereof;

said inner and outer bottom walls being connected in a plurality of spaced apart locations;

said inner sidewall and inner bottom wall being thinner than said outer sidewall and bottom wall, so as to flex upon dynamic impacts thereto; and a lid removably connected to the upper end of said drum to seal the container.

9. A waster container, comprising:

a generally cylindrical double-wall drum having separate spaced apart inner and outer sidewalls and separate spaced apart inner and outer bottom walls;

said inner and outer sidewalls being continously connected at an upper end thereof;

said inner and outer bottom walls being connected in a plurality of spaced apart locations;

a lid removably connected to the upper end of said drum to seal the container;

a neck portion formed at the upper end of said drum, having a greater diameter than the outer sidewall and having inner and outer faces;

the inner faces of said neck portion having threads formed therein;

said lid having upper and lower horizontal walls and a generally cylindrical vertical sidewall connecting the upper and lower walls;

said lid having an exterior thread formed in a portion of said sidewall adapted to engage the neck portion thread to connect the lid to the drum;

said lid being hollow, with said upper and lower walls spaced apart to form a double-walled lid; and an insert formed within said lid, said insert including spoke members radiating from a central hub, said spokes connected along upper and lower edges between upper and lower walls of said lid.

* * * * *